US005983547A

United States Patent [19]

Ellis

[11] Patent Number: 5,983,547

[45] Date of Patent: Nov. 16, 1999

[54] TOGGLE ACTUATED ARTWORK RETAINER

[76] Inventor: Charles E. Ellis, 6 Sheffield St., Pepperell, Mass. 01463

[21] Appl. No.: 09/265,263

[22] Filed: Mar. 9, 1999

[51] Int. Cl.[6] ..... A47G 1/06

[52] U.S. Cl. ..... 40/790; 40/792; 40/796; 411/457; 248/217.2

[58] Field of Search ..... 40/790, 792, 796; 411/457; 248/217.2, 216.1, 488

[56] References Cited

U.S. PATENT DOCUMENTS

| | | | |
|---|---|---|---|
| 230,631 | 8/1880 | Hubbard . | |
| 700,256 | 5/1902 | Tapscott | 40/796 |
| 1,056,530 | 3/1913 | Freirich | 248/217.2 |
| 1,159,813 | 11/1915 | Volkhardt | 248/217.2 X |
| 1,286,588 | 12/1918 | Goodykoontz | 248/217.2 X |
| 1,764,882 | 6/1930 | Newquist . | |
| 2,632,971 | 3/1953 | Manczek et al. . | |
| 3,170,214 | 2/1965 | Cochrane . | |
| 4,045,898 | 9/1977 | Reinhardt . | |
| 4,189,082 | 2/1980 | Solomon . | |
| 4,347,754 | 9/1982 | Wehler . | |
| 4,953,312 | 9/1990 | Astolfi . | |
| 4,980,983 | 1/1991 | Champley . | |
| 5,052,136 | 10/1991 | Poggiolini . | |
| 5,199,681 | 4/1993 | Reidy . | |
| 5,659,990 | 8/1997 | Henneman et al. . | |

*Primary Examiner*—Cassandra H. Davis

*Attorney, Agent, or Firm*—Scott B. Garrison; Lambert & Garrison PLLC

[57] ABSTRACT

A four bar kinematic artwork retainer that attaches to a frame for securely holding artwork in a frame. The four bar kinematic artwork retainer device is installed for retaining artwork in a frame by positioning the pivot pin interconnecting two point links of the retracted artwork retainer in the inside corner of a frame and then locking the artwork retainer in position wherein the piercing points of the artwork retainer have engaged with the frame. The installed artwork retainer is in intimate contact with the back of the artwork and corner of the frame. The artwork retainer quickly, safely and easily attaches to the frame without modifying the frame or using tools.

24 Claims, 7 Drawing Sheets

TOGGLE ACTUATED ARTWORK RETAINER

BACKGROUND OF THE INVENTION

This invention generally relates to artwork frames. More particularly, this invention relates an art frame retainer with toggle actuated picture points for holding works of art in a frame which is easy to install and yet securely holds the artwork in the frame.

Artwork is currently secured in a picture frame by such devices as glazier's points, brads, staples, adhesive tape, spring loaded clips and special panels. U.S. Pat. Nos. 230,631 and 1,764,882, incorporated herein by this reference, disclose a glazier's point for holding glass and artwork in a frame. Tools are usually required to install glazier's points due to the shape and size of glazier's points. U.S. Pat. No. 4,189,082, incorporated herein by this reference, discloses one such tool to facilitate the installation of glazier's points into the wooden frames of picture frames or windows. The use of protective equipment, such as gloves, is prudent to avoid injury to the user when handling glazier's points.

Still, other prior art devices require that the device for holding artwork in a frame be nearly as large if not larger than the artwork being held by the retaining device. Such devices are disclosed and herein incorporated by this reference in U.S. Pat. Nos. 2,632,971; 4,045,898; 4,953,312 and 5,659,990. Accordingly, the fastening device must be similar in size to the picture frame into which the device will be installed.

Spring clamps, such as those disclosed in U.S. Pat. No. 4,980,983, incorporated herein by this reference, disclose a spring clamp that is mounted on the back of a picture frame. Securing artwork in a frame by means of spring clamps requires special preparation of the frame before the spring clamps can be used. Such special preparation may include the machining of slots in the frame, into which the spring clamps are inserted, or the assembly of cleats to the frame, which serve as a support for the spring clamps. Special preparation of the frame is labor intensive and additionally requires tools for the assembly and disassembly of the spring clamps. Like many other clamps and retainers, this spring clamp is necessarily mounted on the back surface of the frame. The frame is therefore offset from the wall on which the frame is attached a distance equal to the thickness of the spring clamp.

Also, U.S. Pat. No. 5,052,136, incorporated herein by this reference, discloses an artwork assembly bracket device that must be physically attached to the artwork or frame by fasteners, i.e. nails, screws, brads or adhesives. U.S. Pat. No. 5,199,681, incorporated herein by this reference, comprises a corner bracket wherein a friction grip physically engages the front and back surfaces of a poster.

Adhesives and tapes have also been used to secure artwork in frames. The mechanical properties of adhesives, when used alone or when deposited on a tape, may degrade over time, rendering this method of attachment ineffective. Also, given the physical properties of adhesives, removal of the adhesive or tape presents the risk of damaging the frame and artwork.

SUMMARY OF THE INVENTION

It is therefore an object of this invention to provide an artwork retaining device that is quickly, safely and easily installed on a picture frame for securely holding artwork in the frame.

It is a further object of this invention to provide an artwork retaining device that is inexpensive to manufacture and uncomplicated to use. It is a further object of this invention to provide an artwork retaining device that does not require the use of tools for the installation or disassembly of the device on frames.

It is a further object of this invention to provide an artwork retaining device that is relatively small in comparison to the frame in which it is installed.

It is a further object of this invention to provide an artwork retaining device that does not require modification of the frame in which it is installed.

It is a further object of this invention to provide an artwork retaining device that can accommodate frames of different sizes without size adjustment to the artwork retainer device.

It is a further object of this invention to provide an artwork retaining device that is unobtrusive when installed, thereby not interfering or altering the mounting of the frame.

It is a further object of this invention to provide an artwork retaining device that can be repeatedly used over and over with the same frame or with substitute frames as the user sees fit.

This invention results from the realization that a less complex, relatively unobtrusive and easy to install and therefore better artwork retainer is effectuated by making the artwork retainer of four rigid mechanical links, at least some having piercing points, joined by four pivot pins. The artwork retainer is installed and removed without the use of tools, yet the artwork retainer locks into its installed position to securely hold the artwork in its frame.

This invention features a four bar kinematic artwork retainer device comprising four rigid links and four pivot pins interconnecting the four rigid links. The four rigid links include two rigid links with at least one piercing point disposed thereon and two rigid links without piercing points. The two rigid links with piercing points are of equal length and are conveniently referred to as point links. The point links will contact the frame when this artwork retainer is in its installed position. The two rigid links without piercing points are of equal length and referred to as toggle links. The two toggle links are pivotally interconnected near one of their ends by a pivot pin passing through the two toggle links. The point links are likewise interconnected by a pivot pin. The remaining two pivot pins similarly join the interconnected point links and toggle links together, forming a planar quadrangle with movable angles. The movable angles are formed by adjacent rigid links joined by a pivot pin. Each pivot pin passes through two links, holds the two links together in close proximity with one another and allows the two links to rotate relative to each other. Taken together, the four pivot pins are positioned to allow the artwork retainer device to be determinate throughout its entire motion.

In most embodiments, for function and economy of material, the four rigid links are made of sheet metal with stiffening flanges bent at a right angle to the planar surface of the artwork. These stiffening flanges are restricted in height so that when installed, the stiffening flanges do not interfere with the wall upon which the artwork and picture frame are mounted for viewing. One or more stiffening flanges are preferably incorporated into each toggle link. The stiffening flanges on the two toggle links further comprise means for the user to actuate or bias the artwork retainer device into its locked or retracted positions. Stiffening flanges may also be incorporated into the two point links.

In a preferred embodiment, a stop is incorporated into preferably at least one of the point links. In the installed and locked position, one of the toggle links comes into intimate contact with the stop. The stop is situated such that once the toggle link contacts the stop, the angle between the toggle links is approximately one hundred and eighty degrees. This position places the artwork retainer device into the configuration of approximately a plane right triangle, with the toggle links forming the hypotenuse of the triangle. The columnar strength of the toggle links in their locked and opposed position prevents the point links from pivoting or deviating from their installed position, making the formative geometry of the artwork retainer device statically determinate. In the fully installed and locked position, the piercing points have penetrated the picture frame and the artwork retainer device has secured the corner of the artwork in the corner of the picture frame.

In the retracted position, i.e. not the installed and locked position, the artwork retainer device approximately forms a plane quadrangle with the angle between the two point links being sufficiently acute to allow the entire artwork retainer device, including the piercing points, to fit comfortably within the ninety degrees of the inside corner of the picture frame without interference between the artwork retainer device and the sides of the picture frame. Thus, the artwork retainer of this invention can easily be placed in intimate contact with the back of the artwork and the corner of the picture frame without the need to modify the frame or use tools to facilitate the installation and removal of the artwork retainer of this invention.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

DETAILED DESCRIPTION OF THE PREFERRED EMBODIMENT

Figure 1:
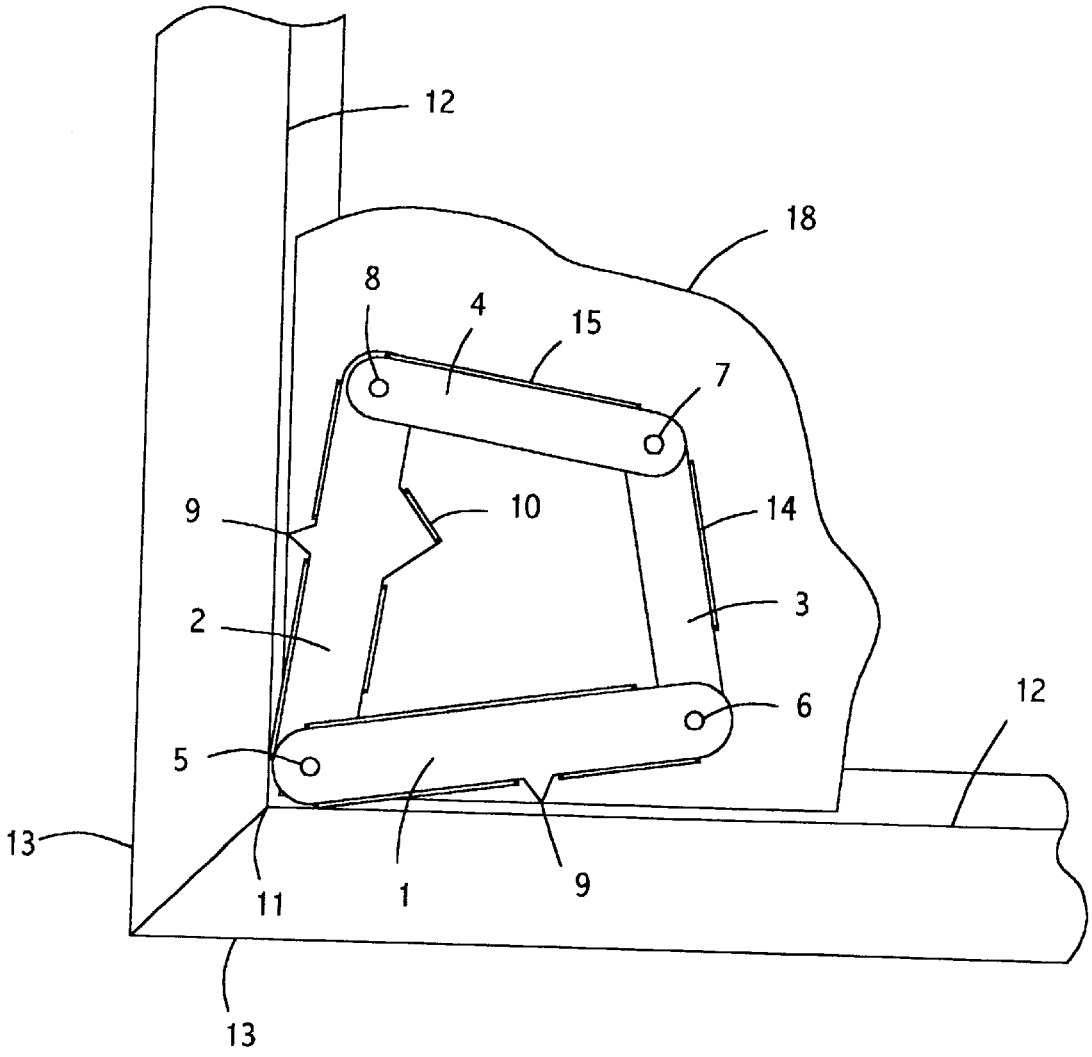
FIG. 1 is a top view of the present invention depicted in a retracted position, in intimate contact with the reverse side of a piece of artwork and further located at the inside corner of a picture frame, the artwork and frame forming no part of the invention.

With reference to FIG. 1, the artwork retainer is shown located in an inside corner 11 of the picture frame, in the retracted position and in intimate contact with the reverse side of artwork 18. A preferred embodiment of the present invention comprises eight components, namely a point link 1, a point link 2, a toggle link 3, a toggle link 4, and four pivot pins 5, 6, 7, and 8. Disclosed on the point links, I and 2, are piercing points 9. The piercing points 9 extend outward from the sides of the point links 1 and 2, and terminate in a sharp point to facilitate the piercing of the picture frame material. The base of each piercing point 9, where the piercing point 9 originates, is sufficiently wide in dimension so that the piercing point 9 remains rigid, and does not bend or curl during the piercing of the picture frame. To further promote sufficient resistance to bending, curling or other deformities the piercing point may be integrally incorporated into the point links 1 and 2. Incorporated into the point link 2 is a stop 10. The point link 1 and the toggle link 4 are positioned on top of the point link 2 and the toggle link 3. The ends of the four rigid links 1, 2, 3, and 4 are radius in form or shaped to provide clearance, fit, and proper function during actuation of the artwork retainer. As FIG. 1 illustrates, when the artwork retainer is retracted, the angle between the point links 1 and 2 is sufficiently acute to allow the piercing points 9 to clear the sides 12 of the picture frame.

Figure 2:
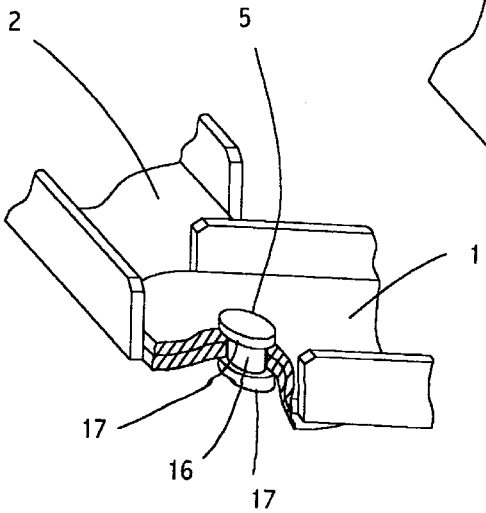
FIG. 2 is a sectional view in perspective of a pivot pin of FIG. 1, depicting the pivot pin passing through two links and holding the two links in close proximity with one another.

FIG. 2 is a detailed illustration depicting the typical relational configuration of the pivot pins 5, 6, 7, 8 and the rigid links 1, 2, 3, 4 of the artwork retainer. Specifically, the pivot pin 5 is shown passing through the point link 1 and the point link 2. The pivot pins 5, 6, 7, and 8 comprise a body 16 and a flange 17. Incorporated into the pivot pin 5 are a pair of flanges 17 located at opposite ends of the body 16 of flange 17. The two flanges 17, or other means, maintain the two point links 1 and 2 in close proximity with one another. The body 16 of the pivot pin 5 is cylindrical in form and passes through axially aligned round holes in the two point links 1 and 2, thereby allowing the two point links 1 and 2 to pivot with respect to one another. The axial center of pivot pin 5 thereby defines the center of the pivot position for the two point links 1 and 2. Similarly, the pivot pins 5, 6, 7 and 8 likewise define the center of the pivot positions for the two rigid links that they respectively interconnect. With reference to FIG. 1, the center of the pivot pin 6 defines the center of the pivot position for the point link 1 and toggle link 3; the center of the pivot pin 7 defines the center of the pivot position for the toggle links 3 and 4; and the center of the pivot pin 8 defines the center of the pivot position for the point link 2 and toggle link 4.

Figure 3:
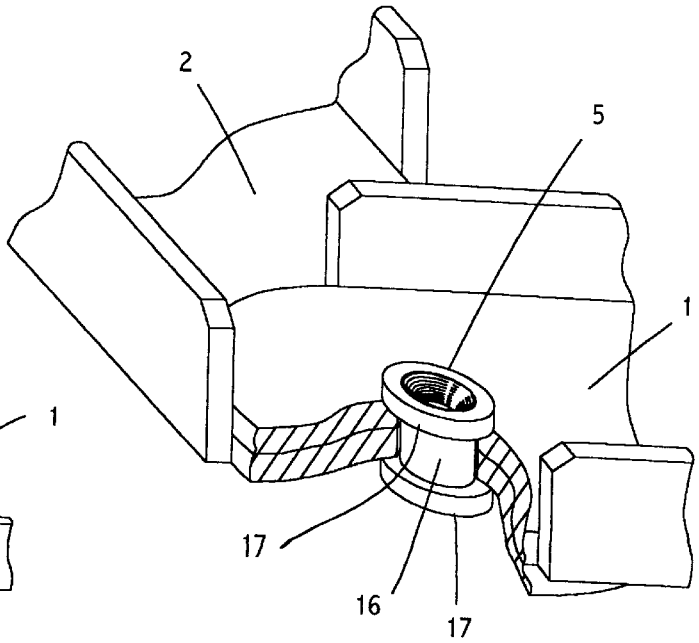
FIG. 3 is a sectional view in perspective showing a modified form of the FIG. 2 pivot pin.

FIG. 3 is a detailed illustration of a modified form of the typical pivot pin 5, 6, 7 and 8. The body 16 of the pivot pin 5 depicted is tubular in form. The ends of the body 16 tubing are flared to form the two flanges 17. The pivot pin 5 is typically made of a metallic material, such as steel or brass.

Figure 4:
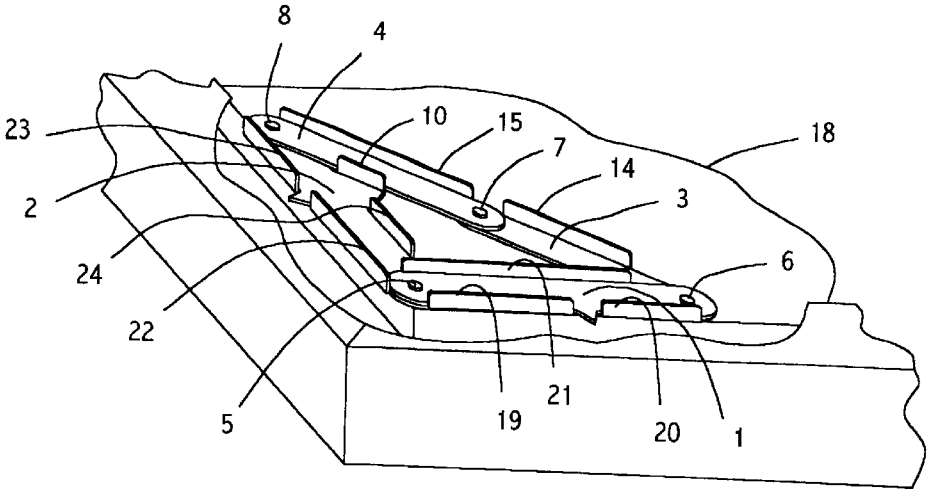
FIG. 4 is a top perspective view of the FIG. 1 invention in the locked position.

With reference to FIG. 4, incorporated into the right toggle link 3 is a stiffening flange 14 bent at a right angle to the toggle link 3. Incorporated into the toggle link 4 is a stiffening flange 15 bent at a right angle to the toggle link 4. These stiffening flanges 14 and 15 are restricted in height so that the artwork retainer device does not interfere with the wall after the artwork and picture frame assembly is mounted on a wall for viewing. Also depicted in FIG. 4, is a stop 10 incorporated into the point link 2. This typical stop 10 is restricted in height so that the artwork retainer device does not interfere with the wall when the artwork and picture frame assembly is mounted on a wall for viewing. In other words, the artwork retainer is unobtrusive with respect to the frame.

Figure 5:
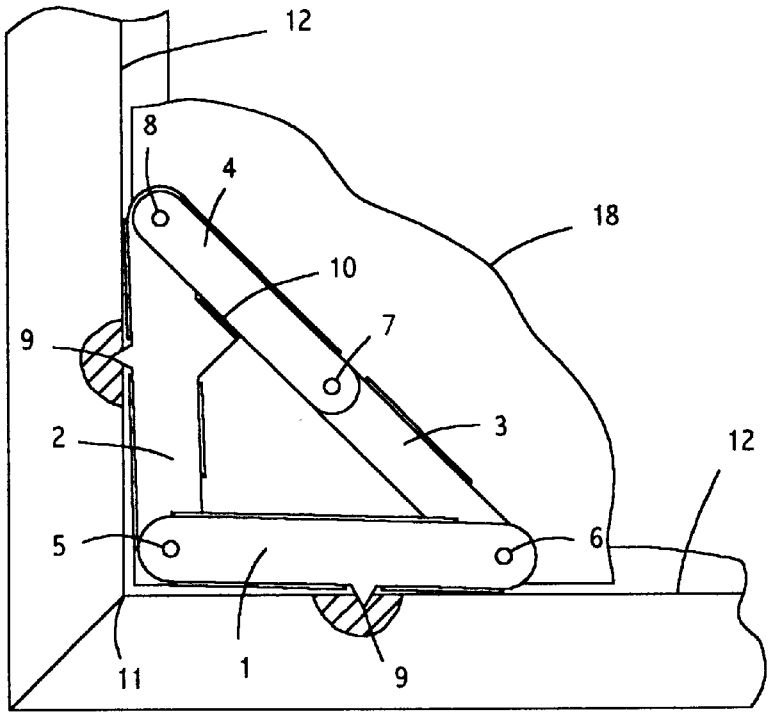
FIG. 5 is a top view of the FIG. 1 in the fully installed and locked position with the piercing points penetrating the picture frame.

With reference to FIG. 1, the user can easily actuate the artwork retainer by hand by placing the thumbs on the corner of the picture frame at locations 13 and the index fingers on the stiffening flanges 14 and 15 of the toggle links 3 and 4, and then squeezing the index fingers toward the thumbs. This squeezing force causes the artwork retainer device to travel to the fully locked position as depicted in FIG. 5. During travel from the retracted position to the locked position, the pivot position defined by the pivot pin 7 moves toward the corner 1 of the picture frame, causing the pivot positions defined by the pivot pins 6 and 8 to move outward toward the sides 12 of the picture frame, and thereby causing the point links 1 and 2 to pivot within the corner of the picture frame 11 about pivot pin 5. When the piercing points 9 begin to engage the sides 12 of the picture frame, the piercing points 9 begin to act as fulcrums, thereby causing the point links 1 and 2 to begin to pivot about the piercing points 9, and thereby causing the pivot position defined by pivot pin 5 to begin to disengage from the corner of the picture frame 11. If the piercing point 9 of the point link 1 is closer to the pivot pin 5 than to the pivot pin 6 and the piercing point 9 of the point link 2 is closer to the pivot pin 5 than to the pivot pin 8, then piercing engagement of the piercing points 9 into the sides 12 of the picture frame is incomplete. The mechanical advantage of this artwork retainer is greater the closer the piercing points 9 are to the pivot pin 5; however, for complete piercing engagement of the piercing points 9 into the sides 12 of the picture frame to occur, the distance from the piercing point 9 of point link I should be closer to the pivot pin 6 than to pivot pin 5, and the piercing point 9 of the point link 2 should be closer to the pivot pin 8 than to the pivot pin 5. The distance of the piercing points 9 should be approximately equidistant from the pivot pin 5 for symmetrical movement of the artwork retainer device, and hence easy actuation by the user.

With reference to FIG. 5, the artwork retainer is depicted in the fully installed and locked position with the piercing points 9 penetrating the sides 12 of the picture frame. In the locked position, the toggle link 4 is in intimate contact with the stop 10, and the stop 10 is located such that when the toggle link 4 is in intimate contact with the stop 10, a line drawn from the center of the pivot pin 6 to the center of the pivot pin 8 approximately intersects the center of pivot pin 7. Hence, in the locked position the toggle links are approximately in line and geometrically opposed with one another so that the artwork retainer device, taken as a whole, approximates a triangle. Because the pivot position defined by the pivot pin 5 has disengaged from the corner 11 of the picture frame, when the artwork retainer device is in the locked position, the angle between the point link 1 and the point link 2 should be slightly obtuse to provide the deepest possible penetration of the piercing points 9 into the sides 12 of the picture frame.

In the fully installed and locked position it is the columnar strength of the aligned toggle links 3 and 4 which maintains the artwork retainer device in the locked position. To ensure that the opposing forces imposed upon the piercing points 9 by the sides 12 of the picture frame do not cause the aligned toggle links 3 and 4 to buckle by rotating at pivot pin 7, it is necessary that pivot pins 6, 7, and 8 are either perfectly aligned or the pivot pin 7 is biased slightly toward the pivot pin 5. If the pivot pin 7 is biased slightly toward the pivot pin 5, then buckling forces will cause the toggle link 4 to impose itself more tightly against the stop 10, thereby keeping the artwork retainer device statically determinate.

Figure 6:
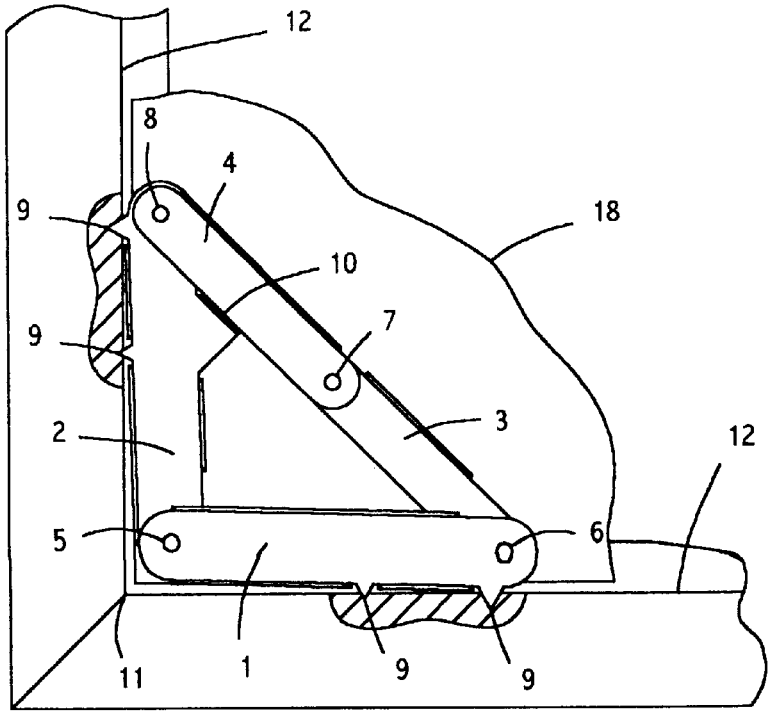
FIG. 6 is a top view showing a alternative embodiment of FIG. 1.

FIG. 6 illustrates a modified form of the artwork retainer device having more than one of the piercing points 9 in each of the point links 1 and 2.

Figure 7:
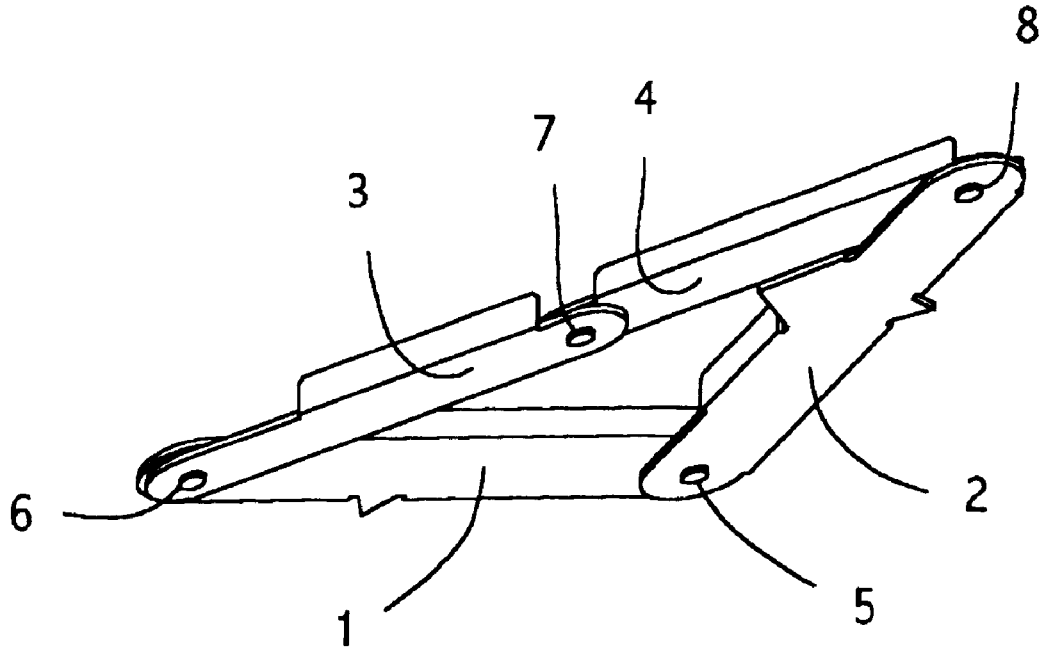
FIG. 7 is a bottom perspective view of the FIG. 1 in the locked position.

FIG. 7 depicts the bottom of the artwork retainer device, showing that the ends of the point link 2 and the toggle link 3 are radius in form or shaped to provide clearance, fit, and proper function during actuation of the artwork retainer device.

With reference to FIG. 4, the two point links 1, 2 and the two toggle links 3, 4 are depicted with a plurality of stiffening flanges 14, 15, 19, 20, 21, 22, 23 and 24 attached to the rigid links 1, 2, 3 and 4. The stiffening flanges 14, 15, 19, 20, 21, 22, 23, and 24 may be integrally incorporated into each of the four rigid links 1, 2, 3, and 4. As depicted, the stiffening flanges are bent at a right angle forming the sides of the four links, and increase the moment of inertia of each link. When the artwork retainer device is in the fully installed and locked position, the stiffening flanges maintain the artwork retainer in a plane parallel with the reverse side of the artwork, and prevent the links from buckling, bending, and twisting. The stiffening flanges 19 and 21 extend as far as possible to the end of the point link 1 adjacent to the pivot pin 5. Similarly, the stiffening flange 22 extends as far as possible to the end of the point link 2 adjacent to the pivot pin 5. At the end of the point link 2 adjacent to the pivot pin 5, the stiffening flange 24 is terminated to clear the point link 1 when the artwork retainer device is in the retracted position with sufficient clearance so that there is no pinch point which might pinch the user's finger during hand retraction of the artwork retainer. The stiffening flanges 19, 20, 22, and 23 terminate at base origination location of the piercing points 9 to facilitate manufacture of the point links 1 and 2. The stiffening flange 20 extends as far as possible to the end of the point link 1 adjacent to the pivot pin 6. Similarly, the stiffening flange 23 extends as far as possible to the end of the point link 2 adjacent to the pivot pin 8. The ends of the stiffening flanges 14 and 21 adjacent to the pivot pin 6 terminate so that when the artwork retainer device is in the locked position there is sufficient clearance between the stiffening flanges 14 and 21 so that there is no pinch point which might pinch the user's finger during actuation of the artwork retainer device. Similarly, the ends of the stiffening flanges 14 and 15 adjacent to the pivot pin 7 terminate so that when the artwork retainer device is in the locked position there is sufficient clearance between the stiffening flanges 14 and 15 so that there is no pinch point which might pinch the user's finger during actuation of the artwork retainer device. The stiffening flange 15 extends as far as possible to the end of the toggle link 4 adjacent to the pivot pin 8. Similarly, the stiffening flange 23 extends as far as possible to the end of the point link 2 adjacent to the pivot pin 8. The corners of the stop 10 and the stiffening flanges 14, 15, 19, 20, 21, 22, 23 and 24 are chamfered, or otherwise broken, so that no sharp corners exist which might otherwise pose a risk of injury to the user of the artwork retainer.

Figure 8:
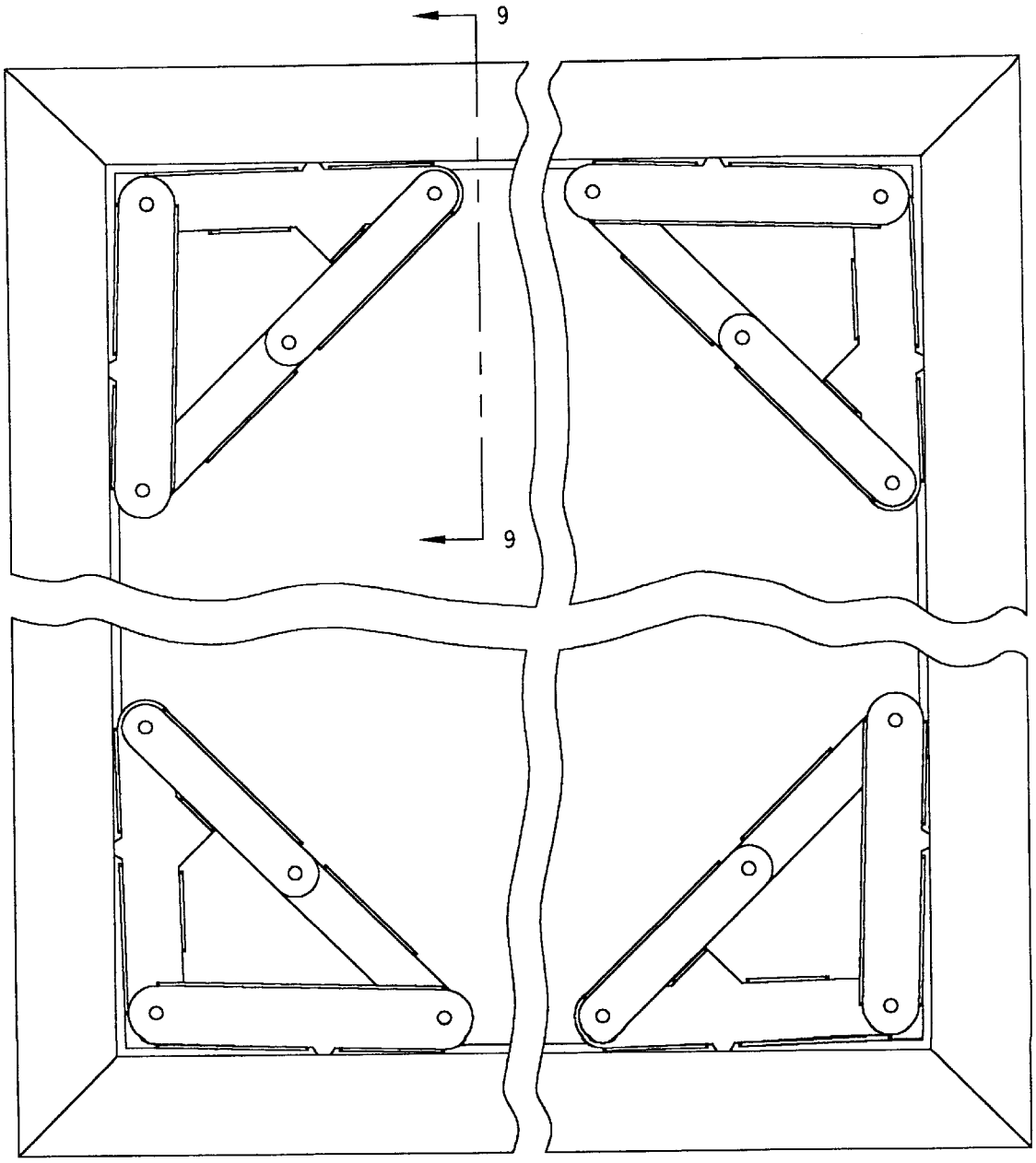
FIG. 8 is a top view of the artwork and picture frame assembly with an invention FIG. 1 in each of the four corners of the picture frame.

FIG. 8 is a view of the reverse side of the artwork, picture frame and artwork retainer assembly. The four artwork retainers, one installed in each corner of the picture frame, are required to complete the assembly.

Figure 9:
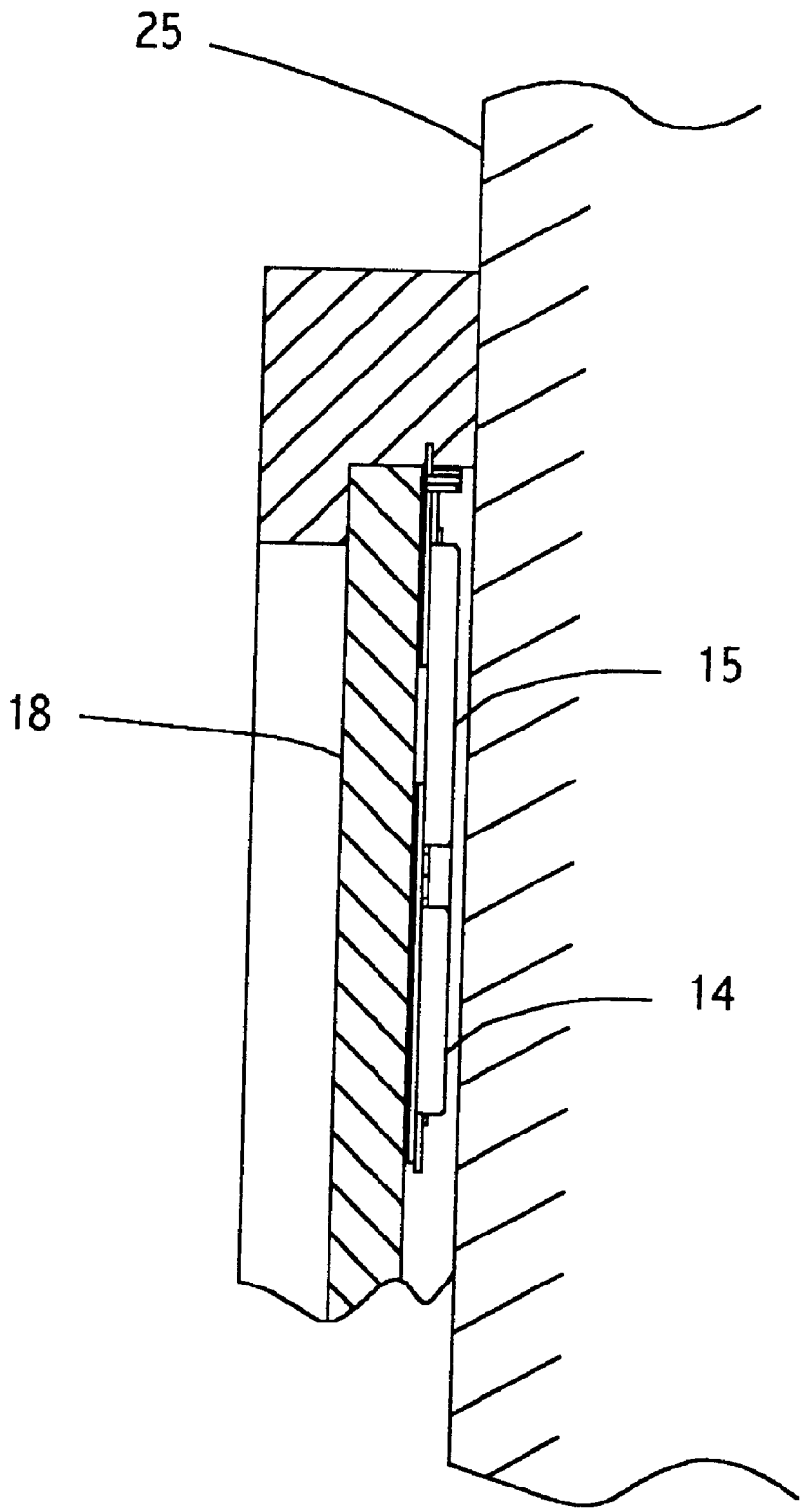
FIG. 9 is a side view in section showing the artwork and picture frame assembly mounted on the wall for viewing.

FIG. 9 is a side view in section of the picture frame, artwork 18, and artwork retainer device assembly mounted against a wall surface 25 for viewing. FIG. 9 clearly depicts the unobtrusive, low-profile manner in which the stop 10 and all of the stiffening flanges, such as 14 and 15, are restricted in height so that the stop 10 and the stiffening flanges do not contact the wall surface 25, or impede proper mounting of the artwork assembly for viewing. The stop 10 and the stiffening flanges 14, 15, 19, 20, 21, 22, 23 and 24 are restricted in height so that the artwork retainer is unobtrusive and the reverse side of the picture frame is able to contact the wall surface 25 when the artwork assembly is mounted against the wall for viewing.

Figure 10:
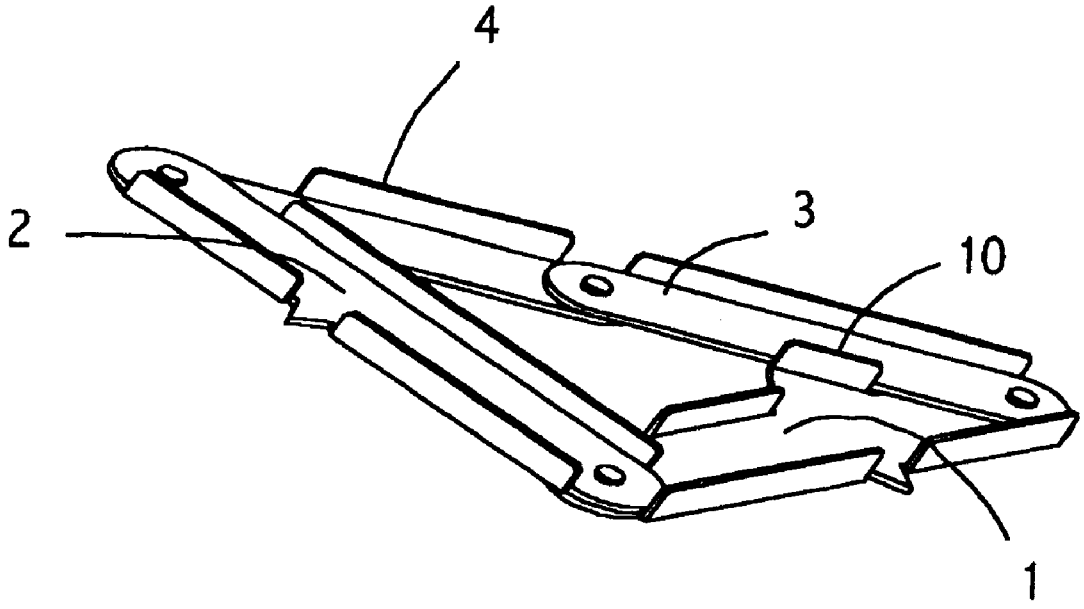
FIG. 10 is a top perspective view showing an alternative embodiment of the FIG. 1 or FIG. 6 invention in the locked position.

FIG. 10 is an illustration in perspective of a modified form of the artwork retainer device. The stop 10 is incorporated into the point link 1. The point link 2 and the toggle link 3 are positioned on top of the point link 1 and the toggle link 4.

As such the method of making and using the device detailed above constitutes the inventor's preferred embodiment and alternate embodiments to the invention. The inventor is aware that numerous configurations of the device as a whole or some of its constituent parts are available which would provide the desired results. While the invention has been described and illustrated with reference to specific embodiments, it is understood that these other embodiments may be resorted to without departing from the invention. By way of example, the invention may be adapted to retain and hold panels, such as plywood, in place for covering window openings or other types of building openings encountered on construction sites. Therefore the form of the invention set out above should be considered illustrative and not as limiting the scope of the following claims.

I claim:

1. An artwork retainer apparatus for retaining a picture within a frame comprising:

four rigid links;

four pins, each said pin interconnecting adjacent said links, a first of said pins interconnecting one end of a first of said links to one end of a second of said links such that both links are intimately in contact one with the other in stacked and pivotal relation, further such that the interconnection of each link causes the entire apparatus to form a planar quadrangle with movable angles; and a plurality of piercing points, at least one such point disposed upon each of said first and said second of said links, wherein said first and second links are each pivotally interconnected by said first of said pins and said points are further directed outward from a perimeter of said quadrangle;

whereby placing said first pin at an inside corner of said frame and biasing a second of said pins which interconnect a third and a fourth of said links toward said first pin causes said first and second links to pivot about said first pin such that said piercing points are forcibly pressed into said frame thereby retaining said picture.

2. The artwork retainer apparatus of claim 1 wherein each of said piercing points is disposed upon said first and second links at some point beyond the midpoint of the length of said links as taken from said first pin.

3. The artwork retainer apparatus of claim 1 wherein each of said first and second links has a single piercing point disposed thereon at some point beyond the midpoint of the length of said link as taken from said first pin.

4. The artwork retainer apparatus of claim 1 wherein each of said first and second links has at least two piercing points disposed thereon.

5. The artwork retainer apparatus of claim 1 further comprising a pivotal stop disposed upon at least one of said links for limiting travel of said second pin toward said first pin beyond some desired position.

6. The artwork retainer apparatus of claim 5 wherein said pivotal stop is disposed on said first link.

7. The artwork retainer apparatus of claim 5 wherein said pivotal stop is disposed on said second link.

8. The artwork retainer apparatus of claim 5 wherein said pivotal stop is disposed on said first and second links.

9. The artwork retainer apparatus of claim 1 wherein said rigid links further comprise stiffening flanges integrally attached to at least one of said rigid links imparting stiffness to said at least one rigid link.

10. The apparatus of claim 1 wherein said piercing points disposed upon said first and second links and extending outward from said first and second links terminate in a sharp point to facilitate the piercing of the frame.

11. The apparatus of claim 1 wherein said piercing points are sufficiently wide in dimension at the location where said piercing points are disposed upon said first and second links for remaining rigid and resisting deformity when said piercing points pierce said frame.

12. An artwork retainer apparatus for retaining a picture within a frame comprising:

a plurality of piercing points;

four rigid links comprising two point links and two toggle links wherein at least one of said piercing points is disposed upon each of two said point links, said piercing points extending outward from said point links; and four pivot pins, each said pivot pin interconnecting one end of a first of said rigid links to one end of a second of said rigid links such that both links are intimately in contact one with the other in stacked and pivotal relation such that both of said point links are adjacent and pivotally interconnected by a first of said pivot pins, both of said toggle links are adjacent and pivotally interconnected by a second of said pivot pins and further still such that the interconnection of each of said four links in conjunction with the rigid links causes the entire apparatus to form a planar quadrangle with movable angles whereby placing said first pivot pin interconnecting said point links at an inside corner of the frame and biasing said second pivot pin interconnecting said toggle links toward said first pivot pin causes said point links to pivot about said first pivot pin such that said piercing points are forcibly pressed into the frame thereby retaining said picture in the frame.

13. The artwork retainer apparatus of claim 12 wherein said piercing points extending outward from said point links terminate in a sharp point for penetrating said frame.

14. The artwork retainer of apparatus 12 wherein each of said piercing points is disposed upon said point link at some point beyond the midpoint of the length of said point link as taken from said first pin.

15. The artwork retainer of claim 12 wherein said rigid links are chamfered thereby allowing non-binding movement of the moveable angles.

16. The artwork retainer of claim 12 wherein said point links are of the same length.

17. The artwork retainer of claim 12 wherein said toggle links are of the same length.

18. The artwork retainer of claim 12 wherein said artwork retainer is restricted in height thereby not impeding the mounting of said frame and said artwork retainer on a wall and permitting said frame and retained picture assembly to be mounted flush on a wall.

19. The artwork retainer of claim 12 further comprising a stop disposed upon at least one of said rigid links for limiting travel of said second pivot pin interconnecting said toggle links toward said first pivot pin interconnecting said point links beyond some predetermined position.

20. The artwork retainer of claim 19 wherein said stop is disposed upon at least one of said point links.

21. The artwork retainer of claim 19 wherein said stop is restricted in height thereby not impeding the mounting of said frame and said artwork retainer assembly on a wall and permitting said frame and retained picture to be mounted flush with a wall.

22. The artwork retainer apparatus of claim 12 further comprising stiffening flanges attached to at least one of said rigid links thereby imparting more rigidity to said rigid links.

23. The artwork retainer apparatus of claim 22 wherein said stiffening flanges are integrally attached to said rigid links.

24. The artwork retainer of claim 22 wherein said stiffening flanges are restricted in height thereby not impeding the mounting of said frame and said artwork retainer on a wall and permitting said frame and retained picture to be mounted flush with a wall.

* * * * *